US005393044A

United States Patent [19]

Hagihara et al.

[11] Patent Number: 5,393,044

[45] Date of Patent: Feb. 28, 1995

[54] PAPER FEEDER

[75] Inventors: Hideaki Hagihara; Masakiyo Okuda; Souichi Takata, all of Nara, Japan

[73] Assignee: Sharp Kabushiki Kaisha, Osaka, Japan

[21] Appl. No.: 158,409

[22] Filed: Nov. 29, 1993

[30] Foreign Application Priority Data

Dec. 4, 1992 [JP] Japan ..... 4-325481
Sep. 20, 1993 [JP] Japan ..... 5-233213

[51] Int. Cl.[6] ..... B65H 5/00

[52] U.S. Cl. ..... 271/10; 271/114; 271/116; 271/242; 271/258; 271/265

[58] Field of Search ..... 271/242, 10, 116, 114, 271/258, 259, 265, 266, 270, 272

[56] References Cited

U.S. PATENT DOCUMENTS

| | | | |
|---|---|---|---|
| 4,337,935 | 7/1982 | Sawada et al. | 271/242 X |
| 4,621,802 | 11/1986 | Ishida et al. | 271/242 X |
| 4,645,192 | 2/1987 | Watanabe | 271/242 X |
| 4,721,297 | 1/1988 | Katayama | 271/242 X |
| 4,790,524 | 12/1988 | Murakami et al. | 271/242 X |

FOREIGN PATENT DOCUMENTS

| | | | |
|---|---|---|---|
| 62-244846 | 10/1987 | Japan | 271/242 |
| 63-8018 | 2/1988 | Japan . | |
| 1117150 | 5/1989 | Japan | 271/242 |

*Primary Examiner*—David H. Bollinger
*Attorney, Agent, or Firm*—Birch, Stewart, Kolasch & Birch

[57] ABSTRACT

A paper feeder for use in copiers has a feed roller, a conveying roller and a registration roller. The apparatus further includes a feeding-conveying drive section for driving the conveying roller in synchronization with the rotation of the feed roller, and a conveying-registration drive section for driving the conveying roller in synchronization with the rotation of the registration roller. By this structure, the peripheral velocity of the rollers when the feed roller and conveying roller rotate can be set up higher than the peripheral velocity of the rollers when the registration roller and conveying roller rotate. An alternative construction of the apparatus includes a feeding-conveying drive section in which the conveying roller is driven through the conveying roller gear and conveying roller clutch and a conveying-registration drive section in which the conveying roller is driven through a pulley disposed on the rotary shaft of the registration roller, a timing belt and a clutch-equipped pulley disposed on the rotary shaft of the conveying roller. In this construction, the conveying roller is made to be able to be driven either by the feeding-conveying drive section or by the conveying-registration drive section.

3 Claims, 7 Drawing Sheets

INPUT SIGNAL FOR FEED ROLLER CLUTCH

INPUT SIGNAL FOR CONVEYING ROLLER CLUTCH

INPUT SIGNAL FOR REGISTRATION ROLLER CLUTCH

SHEET-DETECTOR OUTPUT SIGNAL

SHEET-DETECTOR OUTPUT SIGNAL

PAPER FEEDER

BACKGROUND OF THE INVENTION (1) Field of the Invention

The present invention relates to a paper feeder for use in an image forming apparatus such as a copier, laser printer, etc.

(2) Description of the Prior Art

In a prior art typical sheet-conveyer used, for example, in copiers, when sheets are to be conveyed from a storage portion to a photoreceptor, the sheet is initially delivered to a registration roller by the rotation of feed roller and conveying roller. Then, after the feed roller and conveying roller stop rotating, the sheet is delivered toward the photoreceptor by rotating the registration roller and conveying roller in time with the rotation of the photoreceptor. At this operation, each of these rollers is rotated at the same peripheral velocity through gears and clutches by a driving force supplied by a motor.

Recent demands for high-speed operating copiers require sheet-feeding speed to increase, but it has been impossible to raise the copy speed in excess of a certain level because each roller should rotate at the peripheral velocity corresponding to that of the photoreceptor.

To deal with this, known prior art methods would take a measure in which only the operation during which the feed roller and conveying roller rotate may speed up. In this method, since the rotational peripheral velocity of the feed roller need be greater than that of the registration roller, the conveying roller is to include a speed-changing mechanism so as to vary its rotational peripheral velocity in dependence upon peripheral velocity of each roller. In such a paper conveying device equipped with the speed-changing mechanism, a driving force given by a motor is transmitted as shown in FIG. 1 from a driving gear 1 through gears 2, 3, 4, 5 and 6 to feed roller 7, conveying roller 8 and registration roller 9.

In this arrangement, as copying operation is activated, a driving clutch 10 is coupled so that rotation of the gear 6 may be transmitted to a shaft 7*a* thus rotating the feed roller 7.

At the time, when a speed-changing clutch 12 in a speed-changing mechanism 11 is connected, the gears 5 and 13 are coupled so that rotating force of the gear 5 is transmitted to a gear 13. The gear 13 causes a gear 14 to rotate which is integrally formed with a shaft 8*a* of the conveying roller 8, whereby the conveying roller 8 may be rotated. Since the gear ratio of the gear 6 to the gear 14 is set up as unit or one, the feed roller 7 and conveying roller 8 rotate at the same peripheral velocity. Accordingly, sheets are conveyed by the rotation in a direction shown in arrows A and B.

Subsequently, when a driving clutch 15 is connected in order to rotate the registration roller 9, rotation of the gear 2 is transmitted to drive the registration roller 9. At this time, by connecting a speed-changing clutch 16 simultaneously, rotation of gear 4 is transmitted to the conveying roller 8. As the gear ratio between the gears 2 and 4 are set up as one, the registration roller 9 and conveying roller 8 are adapted to rotate at the same peripheral velocity.

However, because the feed roller 7 and conveying roller 8 rotate in synchronization with one another as shown in FIG. 1, if the distance between the feed roller 7 and registration roller 8 is greater than the length of the least sheet size, the feed roller 7 unpreferably tends to feed a next sheet.

Further, the speed-changing mechanism 11 composed of clutches and gears is necessary in order to match the peripheral velocity of the conveying roller 8 with those of the feed roller 7 and registration roller 9. This would lower assembling workability resulting in sharp increase in cost. Besides, the driving clutches 10 and 15 should be adapted to operate substantially simultaneously with the speed-changing clutches 12 and 16, respectively. This would complicate combinations of operation-timing signals for controlling activation of the driving clutches 10 and 15 as well as the speed-changing clutches 12 and 16, thus markedly lowering reliability of the device.

SUMMARY OF THE INVENTION

The present invention has been achieved in view of what is discussed above and it is therefore an object of the present invention to provide a paper feeder capable of readily changing over driving mode of rollers with a simple structure.

According to a first aspect of the present invention to achieve the above object, a paper feeder has a feed roller, a conveying roller and a registration roller arranged so as to define a sheet-conveying path along which sheets are conveyed from a sheet-storage portion to a photoreceptor, and further comprises: a feeding-conveying drive section for driving the conveying roller in synchronization with the rotation of the feed roller as the feed roller rotates; and a conveying-registration drive section for driving the conveying roller in synchronization with the rotation of the registration roller as the registration roller rotates, wherein the feeding-conveying drive section has a one-way clutch which will transmit no driving force through the conveying-registration drive section from the registration roller to the feed roller, and the conveying-registration drive section has a one-way clutch which will transmit no driving force through the first driving section from the feed roller to the registration roller.

In this construction, when a sheet is fed from the sheet-storage portion, the conveying roller is activated simultaneously with the start of rotation of the feed roller by means of the feeding-conveying drive section. At this time, driving force may be transmitted also to the convey-registration drive section, but the one-way clutch in the conveying-registration drive section will not allow transmission of the driving force to the registration roller.

Then, when the sheet is conveyed to be caught by the nip at the registration roller, the sheet is temporarily halted. Subsequently, the registration roller is driven.

At this time the conveying-registration drive section drives the conveying roller in synchronization with the registration roller. In this while, driving force may be transmitted also to the feeding-conveying drive section, but the one-way clutch in the feeding-conveying drive section will not allow transmission of the driving force to the feed roller.

Thus, since in the present invention, provision of the one way-clutches for the feeding-conveying and conveying-registration drive sections allows the conveying roller to be driven in synchronization with the rotation of the feed roller as the feed roller rotate and to be driven in synchronization with the rotation of the registration roller as the registration roller rotates. Accordingly, the peripheral velocity of the rollers for delivering the sheet as the feed roller and conveying roller rotate can be set up by a simple structure higher than the peripheral velocity of the rollers when the registration roller and conveying roller rotate. As a result, the time taken for the sheet to be conveyed from the cassette to the registration roller can be shortened thus making it possible to realize fast copy.

According to a second aspect of the present invention to achieve the above object, a paper feeder has a feed roller, a conveying roller and a registration roller arranged so as to define a sheet-conveying path along which sheets are conveyed from a sheet-storage portion to a photoreceptor, comprises: a driving gear assembly composed of a feed roller gear to be connected to the feed roller through a feed roller clutch, a conveying roller gear to be connected to the conveying roller through a conveying roller clutch and a registration roller gear to be connected to the registration roller through a registration roller clutch; and a driving pulley assembly composed of a one-way clutch-equipped pulley disposed on the rotary shaft of the conveying roller, a pulley disposed on the rotary shaft of the registration roller and a timing belt suspended between the pulleys, and is characterized in that two different driving modes of the conveying roller can be set up by means of feeding-conveying and conveying-registration drive sections, wherein driving of the conveying roller by the feeding-conveying drive section is effected through the conveying roller gear and conveying roller clutch whereas driving of the conveying roller by the conveying-registration drive section is effected through the pulley disposed on the rotary shaft of the registration roller, the timing belt and the clutch-equipped pulley disposed on the rotary shaft of the conveying roller.

In this case, it is effective that the paper feeder further comprises: a sheet-detector which detects arrival of a sheet when the leading edge of the sheet reaches the conveying roller so as to halt a signal for activating the feed roller clutch so that the feed roller clutch may be freed to thereby stop the rotation of the feed roller; and a sheet-detector which detects arrival of the sheet when the leading edge of the sheet reaches the registration roller to create bending so as to halt a signal for activating the conveying roller clutch so that the conveying roller clutch may be freed to thereby stop the rotation of the conveying roller.

Thus, according to the present invention, the conveying roller can be driven in the two modes, or through the feeding-conveying drive section or the conveying-registration section, it is possible that the feeding velocity of the sheet fed by the feed roller from the storage portion up to the conveying roller can be set up higher than the velocity of the sheet conveyed from the conveying roller to the registration roller while the conveying roller and the registration roller are driven in complete synchronization with one another.

Accordingly, it is possible to eliminate irregularity of movement of sheets due to dispersion of clutch-coupling timing. In addition, when the sheet delivered by the feed roller reaches the conveying roller, the rotation of the feed roller will halt so as to allow the sheet to be moved only by the conveying roller. Therefore, there is no need to limit the distance between the feed roller and conveying roller when the apparatus is to be designed. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Paper feeders embodied in the present invention will hereinafter be detailed with reference to the accompanying drawings.

Figure 1:
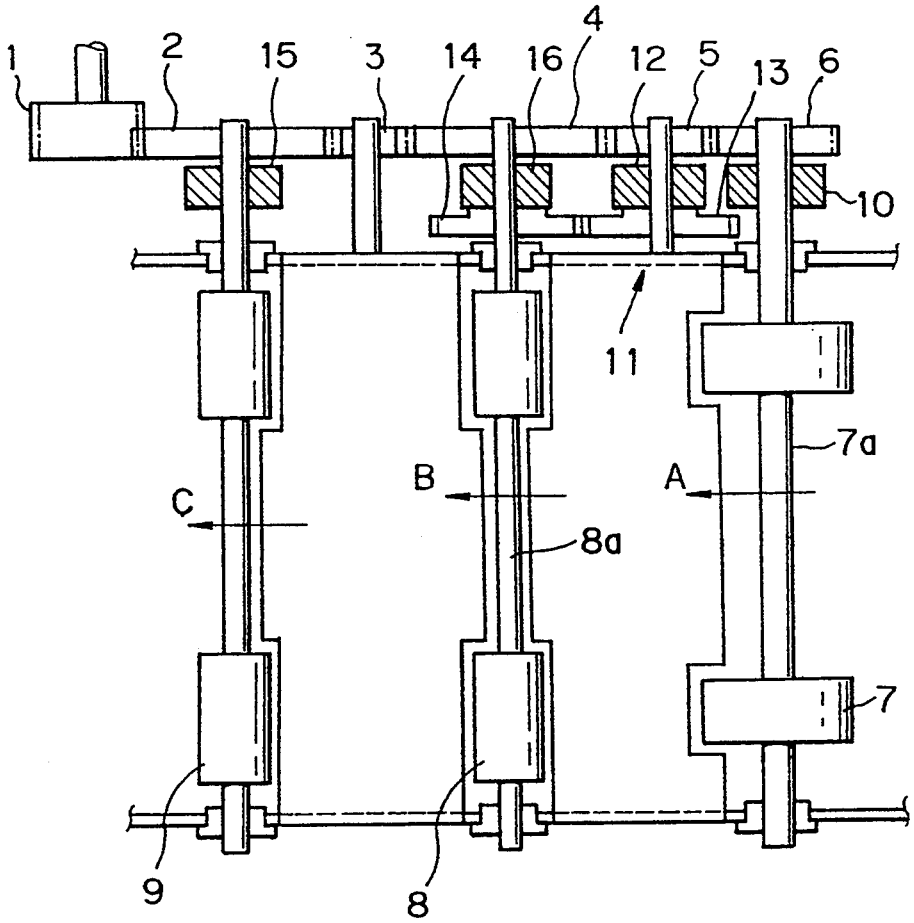
Fig.1 PRIOR ART
FIG. 1 is a structural view showing a prior art paper feeder.
Figure 2:
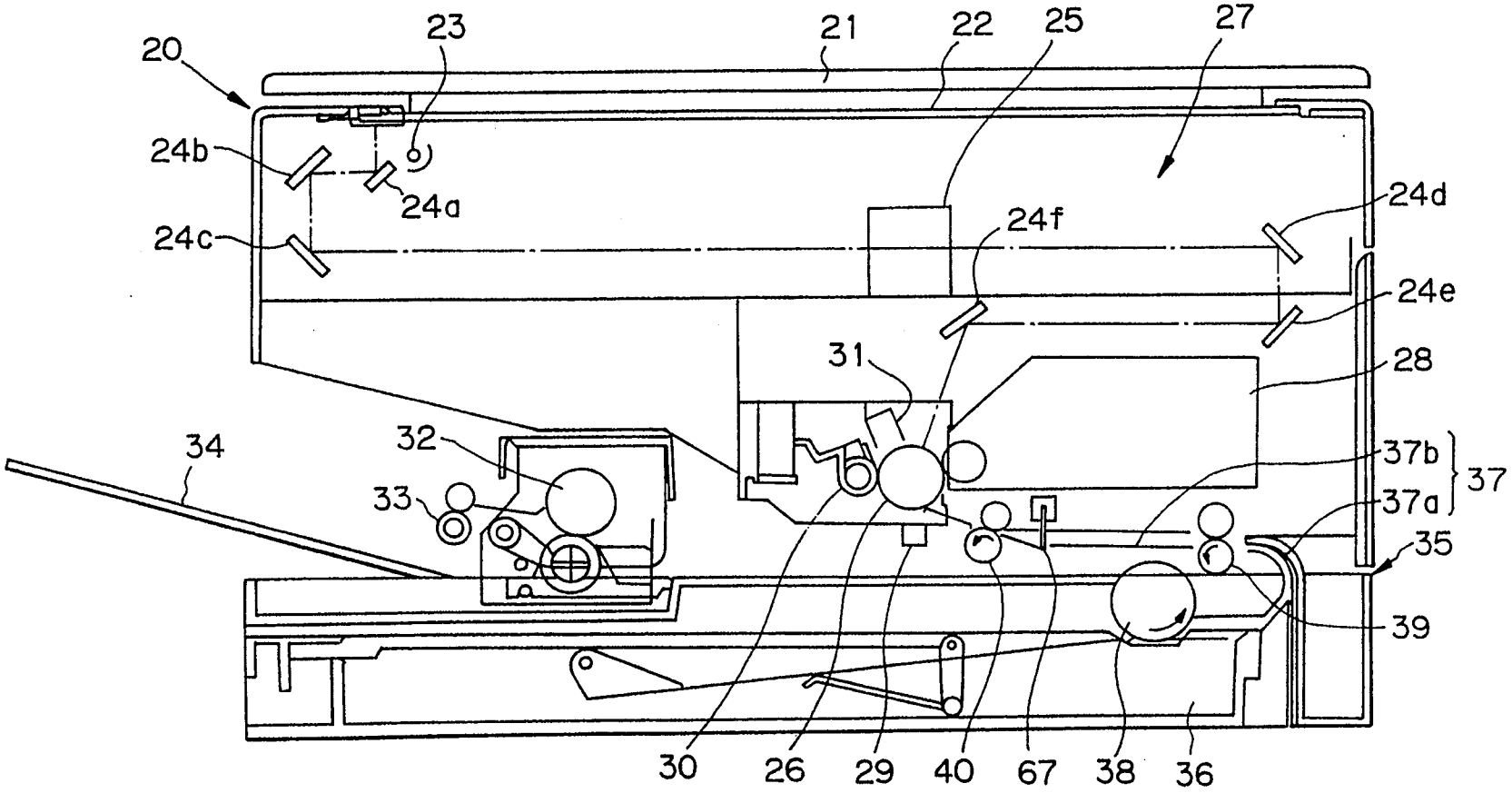
FIG. 2 is a schematic side view showing a copier to which the present invention is applied.

A copier for use in the embodiments includes, as shown in FIG. 2, an original cover 21 on the top of a copier body 20, an original table 22 beneath the original cover 21, an optical system 27 composed of an exposure lamp 23 for illuminating an original placed on the original table 22, mirrors **24*a* through 24*f* and lenses 25 for introducing the reflected light from the original so as to expose a photoreceptor 26. The copier further includes a developing unit 28, a transfer unit 29, cleaning unit 30 and charger unit 31 around the photoreceptor 26 mentioned above. There are also provided a fixing unit 32 for fixing toner particles on a sheet transferred from the photoreceptor 26, a paper discharging roller 33 for discharging the sheet sent out from the fixing unit 32, a paper tray 34 receiving discharged sheets, and a paper feeder 35 for delivering sheets to the photoreceptor 26**.

The paper feeder 35 is comprised of a storage cassette 36 for accommodating sheets, a conveyer section 37 for conveying a sheet from the storage cassette 36 to the photoreceptor 26. In the conveyer section 37, there are provided from upstream side to downstream side along a direction in which sheets are conveyed a feed roller 38 for successively delivering the topmost sheet held in the storage cassette 36, a conveying roller 39 for sending the sheet fed by the feed roller 38 to the downstream side and a registration roller 40 for halting the sheet delivered from the conveying roller 39 just to the side of the photoreceptor 26 and delivering the sheet in time with the rotation of the photoreceptor 26. In the figure, reference numeral 67 designates a sheet detecting switch.

One embodiment of the paper feeder of the present invention applied to the copier shown in FIG. 2 will be described with reference to structural view and side view shown in FIGS. 3 and 4, respectively.

Figure 3:
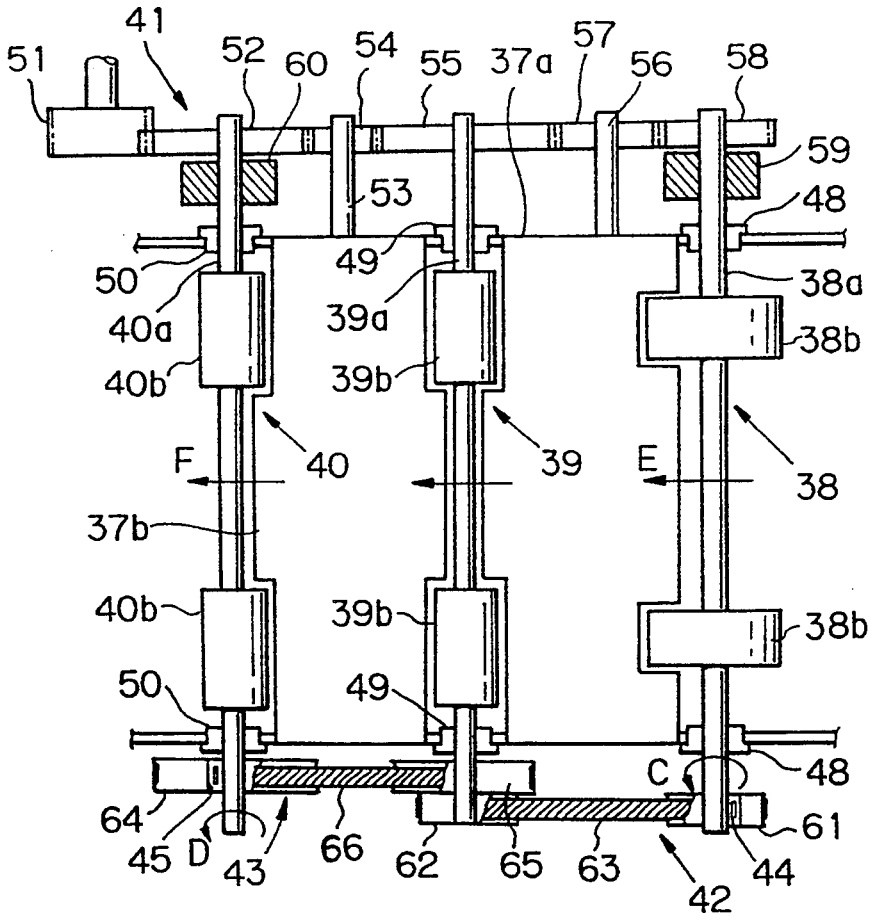
FIG. 3 is a structural view showing a paper feeder of an embodiment of the present invention.

Initially, as shown in FIG. 3, each of the rollers 38, 39 and 40 receives driving force from a motor through a gear mechanism 41.

There are provided two driving sections, namely, a feeding-conveying drive section 42 for driving the conveying roller 39 in synchronization with the feed roller 38 as the feed roller 38 rotates, and a conveying-registration drive section 43 for driving the conveying roller 39 in synchronization with the registration roller 40 as the registration roller 40 rotates.

The feeding-conveying drive section 42 is provided with a one-way clutch 44 which will not transmit driving force (transmitted from the registration roller 40 through the conveying-registration date section 43) to the feed roller 38 whereas the conveying-registration drive section 43 is provided with a one-way clutch 45 which will not transmit driving force (transmitted from the feed roller through the feeding-conveying drive section 42) to the registration roller 40.

In the conveyer section 37, a substantially U-shaped curving sheet guide 37*a* and a sheet-conveying guide plate 37*b* for guiding sheets from the storage cassette 36 toward the photoreceptor 26 are provided from the upstream side to the downstream side of the sheet feeding direction.

The feed roller 38 is composed as shown in FIG. 3 of a pair of roller elements 38*b*, 38*b* which, being arranged in the width direction of the sheet, is externally fit on a roller shaft 38*a* supported rotatably by bearings 48 disposed in the copier body 20.

The conveying roller 39 is composed of a pair of roller elements 39*b*, 39*b* which, being arranged in the width direction of the sheet, is externally fit on a roller shaft 39*a* supported rotatably by bearings 49 disposed in the copier body 20.

The registration roller 40 is composed of a pair of roller elements 40*b*, 40*b* which, being arranged in the width direction of the sheet, is externally fit on a roller shaft 40*a* supported rotatably by bearings 50 disposed in the copier body 20.

The gear mechanism 41 is composed of a driving gear 51 rotated by the driving force given from a motor, a gear 52 which is idly and rotatably fit on a registration roller shaft 40*a* and engages the driving gear 51, an idle gear 54 which is idly and rotatably fit on an idle shaft 53 and engages the gear 52, a gear 55 which is idly and rotatably fit on a conveying roller shaft 39*a* and engages the idle gear 54, an idle gear 57 which is idly and rotatably fit on an idle shaft 56 and engages the gear 55 and a gear 58 which is idly and rotatably fit on a feed roller shaft 38*a* and engages the idle gear 57.

A feeding-conveying drive clutch 59 which is provided for the gear 58 in a connectable and disconnectable manner, transmits driving force from the gear 58 to the roller shaft 38*a* of the feed roller 38 in accordance with a signal sent from an unillustrated controller. On the other hand, a conveying-registration drive clutch 60 which is provided for the gear 52 in a connectable and disconnectable manner, transmits driving force from the gear 52 to the roller shaft 40*a* of the registration roller 40 in accordance with a signal sent from the controller.

The feeding-conveying drive section 42 mentioned above is constructed of a pulley 61 idly fit on the roller shaft 38*a* of the feed roller 38, a first pulley 62 externally fit on the roller shaft 39*a* of the conveying roller 39, a belt 63 wound around the pulley 61 and first pulley 62 and a one-way clutch 44.

The conveying-registration drive section 43 mentioned above is constructed of a pulley 64 idly fit on the roller shaft 40*a* of the registration roller 40, a second pulley 65 externally fit on the roller shaft 39*a* of the conveying roller 39, a belt 66 wound around the pulley 64 and second pulley 65 and a one-way clutch 45.

The one-way clutch 44 mentioned above is mounted as shown in FIG. 4 inside the pulley 61 of the feeding-conveying drive section 42. As the roller shaft 38*a* of the feed roller 38 rotates in a counterclockwise direction shown by arrow C, the clutch 44 is fixed in a locking direction so as to rotate the pulley 61 in the same rotational direction.

The one-way clutch 45 mentioned above is mounted inside the pulley 64 of the conveying-registration drive section 43. As the roller shaft 40*a* of the registration roller 40 rotates in a counterclockwise direction shown by arrow D, the clutch 45 is fixed in a locking direction so as to rotate the pulley 64 in the same rotational direction.

In the thus constructed arrangement, in a case where sheets are fed from the storage cassette 36, pressing a copy switch causes the first driving clutch 59 to be engaged and the conveying-registration drive clutch 60 to be disengaged so that the driving force from the motor is transmitted to the gear mechanism 41. With this operation, the feed roller 38 rotates in a direction shown by arrow C by the driving force through the gear 58 at a higher peripheral velocity than that of the photoreceptor 26.

Subsequently, the one-way clutch 44 is fixed in a locking direction so as to rotate the pulley 61. This rotation is transmitted through the belt 63 to the first pulley 62 of the conveying roller 39. Consequently, the conveying roller 39 may be rotated synchronously at the same peripheral velocity with that of the feed roller 38.

In this while, although the second pulley 65 is also rotated to thereby drive the pulley 64 through the belt 66, the one-way clutch 45 is rotated in a free direction, so that the driving force will not be transmitted to the roller shaft 40*a* of the registration roller 40.

Subsequently, the feed roller 38 pushes out the topmost sheet of the storage cassette 36 in a direction shown by arrow E. The sheet is conveyed by the conveying roller 39 passing through the sheet Guide 37*a* to the side of the registration roller 40.

The sheet having passed through the sheet-conveying guide plate 37*b* from the conveying roller 39 abuts against the sheet-detecting switch 67 disposed just before the registration roller 40. This causes the sheet-detecting switch 67 to turn on, so that the first driving clutch 59 is disconnected. Consequently, the feed roller 38 and conveying roller 39 halt so that the sheet is temporarily halted while being caught by the nip at the registration roller 40.

Then, the conveying-registration drive clutch 60 is connected in time with the rotation of the photoreceptor 26 while the first driving clutch 59 is disconnected. As a result, the registration roller 40 will be rotated in the direction shown by arrow D at the same peripheral velocity as that of the photoreceptor 26.

In this state, the one-way clutch 45 is fixed in a locking direction, so as to transmit its rotation to the pulley 64. The rotation is transmitted to the second pulley 65 of the conveying roller 39 through the belt 66 so that the conveying roller 39 is driven synchronously at the same peripheral velocity with the registration roller 40.

Subsequently, the sheet which has been conveyed by the registration roller 40 and conveying roller 39 in the direction shown by arrow F is delivered toward the photoreceptor 26 so as to create an image on the sheet. This operation will be repeated to reach a predetermined number of copies.

In this while, the first pulley 62 is also rotated and consequently, this rotation is transmitted through the belt 63 to rotate the pulley 61. The one-way clutch 44, however, rotates in a direction in which the locking state of the clutch may be freed, therefore, the driving force will not be transmitted to the roller shaft 38*a* of the feed roller 38.

As stated above, since the paper feeder of the embodiment is provided with the thus constructed feeding conveying and conveying-registration drive sections 42 and 43 having respective one way clutches 44 and 45, this simple structure makes it possible to drive the feed roller 38 and the registration roller 40, respectively and separately in synchronization with the conveying roller 39. Accordingly, it is possible to increase the peripheral velocity of the rollers for delivering the sheet when the feed roller 38 and conveying roller 39 rotate as compared to that when the registration roller 40 and conveying roller 39 rotate. As a result, the time taken for the sheet to be conveyed from the cassette to the registration roller 40 can be shortened thus making it possible to realize fast copy (high speed copy) operation.

Further, as this system does not require any complicated speed-changing mechanism which would be used in the prior art apparatus, the mechanism of the system can be simplified to thereby realize sharp reduction in cost.

Moreover, control signals, etc. for clutches can be simplified allowing the paper feeder to improve in reliability.

The present invention should not be limited to the embodiment described above, and of course many modifications and variation can be added to the aforementioned embodiment within the scope of the present invention.

For example, in the above embodiment, the feeding-conveying and conveying-registration drive sections 42 and 43 are both constructed of a mechanism using pulleys and a belt, but the mechanism can be formed with combination of gears and the like.

As has been apparent from the foregoing description, according to the present invention, the provision of one-way clutches for the first and feeding-conveying and conveying-registration drive sections enables the conveying roller to be driven in synchronization with the feed roller when the feed roller rotates and to be driven in synchronization with the registration roller when the registration roller rotates. As a result, with a simple mechanism it is possible to set up a higher peripheral velocity for when the feed roller and conveying roller rotate than for when the registration roller and conveying roller rotate. Accordingly, the sheet can be conveyed to the registration roller at a higher speed to thereby increase copy operation speed.

Further, as this system does not require any complicated speed-changing mechanism which would be used in the prior art apparatus, the mechanism of the system can be simplified to thereby realize sharp reduction in cost.

Since it is possible to eliminate the speed-changing clutches which would be used in the prior art apparatus and therefore simplify control signals, etc., the present invention contributes to the improvement in reliability of the paper feeder.

Figure 4:
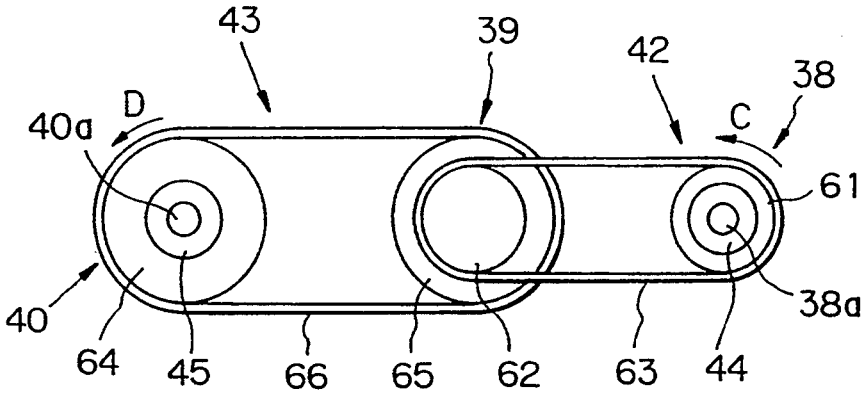
FIG. 4 is a side view showing the apparatus shown in FIG. 3.
Figure 5:
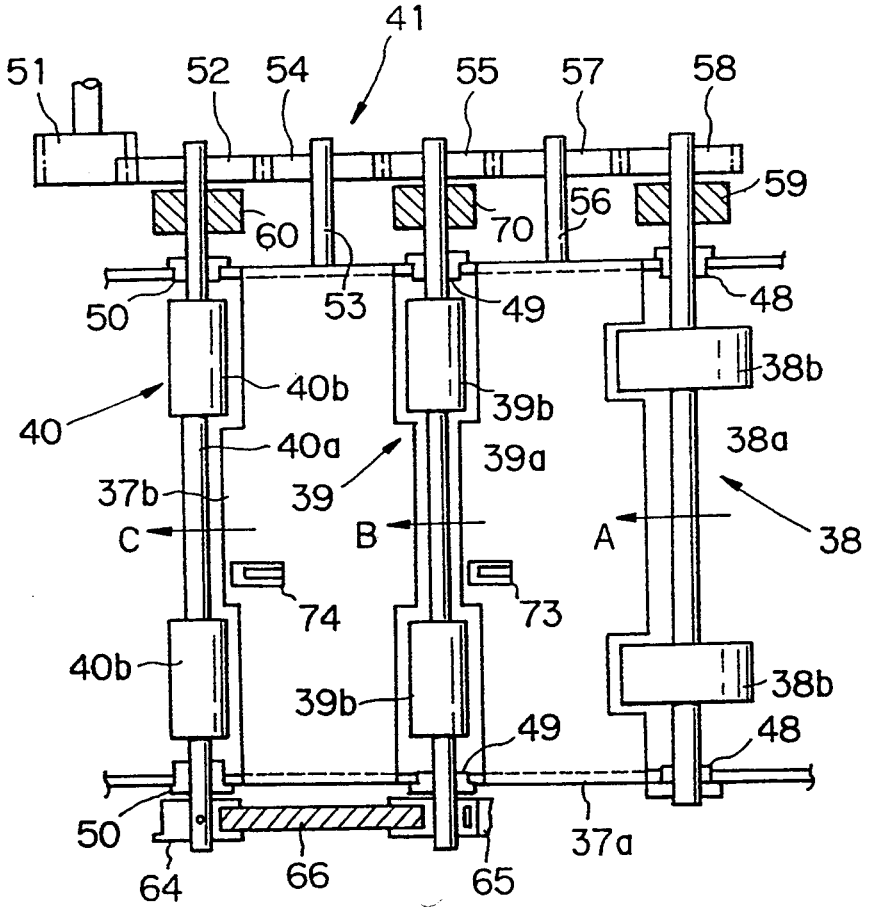
FIG. 5 is a structural view showing a paper feeder of another embodiment of the present invention.
Figure 6:
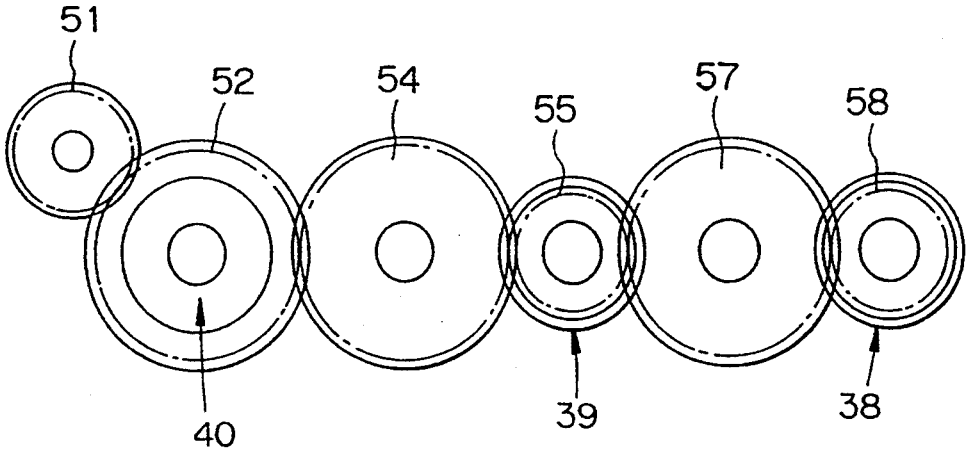
FIG. 6 is a side view showing positional relation of gears and rollers in a feeding-conveying drive section in the apparatus shown in FIG. 5.
Figure 7:
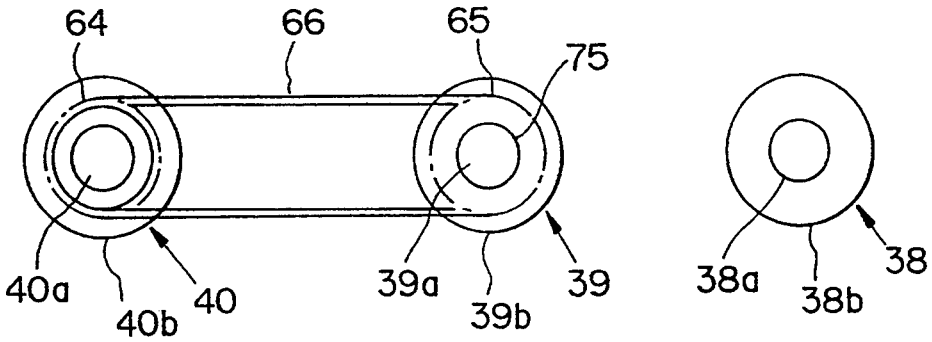
FIG. 7 is a side view showing positional relation of the pulleys, rollers and the like in a conveying-registration drive section in the apparatus shown in FIG. 5.

Although the paper feeder of the present invention has been described heretofore with reference to the embodiment shown in FIGS. 3 and 4, another embodiment of the present invention which allows fast copy operation can be realized by employing a paper feeder having a simple structure of two-speed gear change shown in FIG. 5. Here, FIGS. 6 and 7 are side views for explaining the paper feeder shown in FIG. 5.

In the description of this embodiment, the paper feeder herein is to be applied to the same copier as described in the first embodiment.

As shown in FIG. 5, the feed roller 38 and conveying roller 39 are driven by an unillustrated motor through driving gear 51 and gear mechanism 41.

The feed roller 38 is composed of a rotary shaft 38*a* and a pair of roller elements 38*b*, 38*b* fit on the rotary shaft 38*a* whereas the conveying roller 39 is composed of a rotary shaft 39*a* and a pair of roller elements 39*b*, 39*b* fit on the rotary shaft 39*a*. The registration roller 40 which is composed of a rotary shaft 40*a* and a pair of roller elements 40*b*, 40*b* fit on the rotary shaft 40*a*. These three rollers or roller shafts 38*a*, 39*a*and 40*a* are arranged in parallel with one another keeping with predetermined intervals and supported by respective pair bearings 48, 49 and 50 disposed in a sheet guide 37*a*. Provided on the rear frame side are some gears and clutches. Namely, a feed roller gear 58 is fit on the rotary shaft 38*a* through a feed roller clutch 59, a conveying roller gear 55 is fit on the rotary shaft 39*a* through a conveying roller clutch 70, and a registration roller gear 52 is fit on the rotary shaft 40*a* through a registration roller clutch 60.

An idler gear 57 is provided rotatably on a shaft 56 planted on the sheet guide 37*a* so as to be coupled between the feed roller gear 58 and the conveying roller gear 55. Another idler gear 54 is provided rotatably on a shaft 53 planted on the sheet guide 37*b* so as to be coupled between the conveying roller gear 55 and the registration roller gear 52.

A clutch-equipped pulley 65 having an one-way clutch therein is fit from the front frame side into the rotary shaft 39*a*. A pulley 64 is fit into the rotary shaft 40*a* from the front frame side. A timing belt 66 is suspended between the clutch-equipped pulley 65 and the pulley 64. A sheet detector 73 is placed close to the conveying roller 39 or rotary shaft 39*a* on the upstream side thereof. Similarly another sheet detector 74 is placed close to the registration roller 40 or rotary shaft 40*a* on the upstream side thereof.

The driving gear 51 mentioned above, gears 58, 55, 52, 57 and 54, rollers 38, 39 and 40 are not generally located on a straight line depending on the paper feeding passage 37 in the copier shown in FIG. 2, but a schematic relation of engagement between the gears may be positioned as shown in FIG. 6. The feed roller 38, conveying roller 39 and registration roller 40, pulleys 64 and 65 and suspended timing belt 66 are placed as shown in FIG. 7. In FIG. 7, reference numeral 75 designates the one-way clutch incorporated in the pulley 65.

Here, the conveying roller 39 is driven by either a feeding-conveying drive section in which driving force is transmitted from the motor through driving gear 51, registration roller gear 52, idler gear 54, conveying roller gear 55 and conveying roller clutch 70 to the conveying roller 39 or by a conveying-registration drive section in which driving force is transmitted from the motor through the driving gear 51, registration roller gear 52, registration roller clutch 60, rotary shaft 40, pulley 64, timing belt 66 and pulley 65 having the one-way clutch 75 therein to the conveying roller 39.

Figures 8A, 8B, 8C, 8D, 8E:
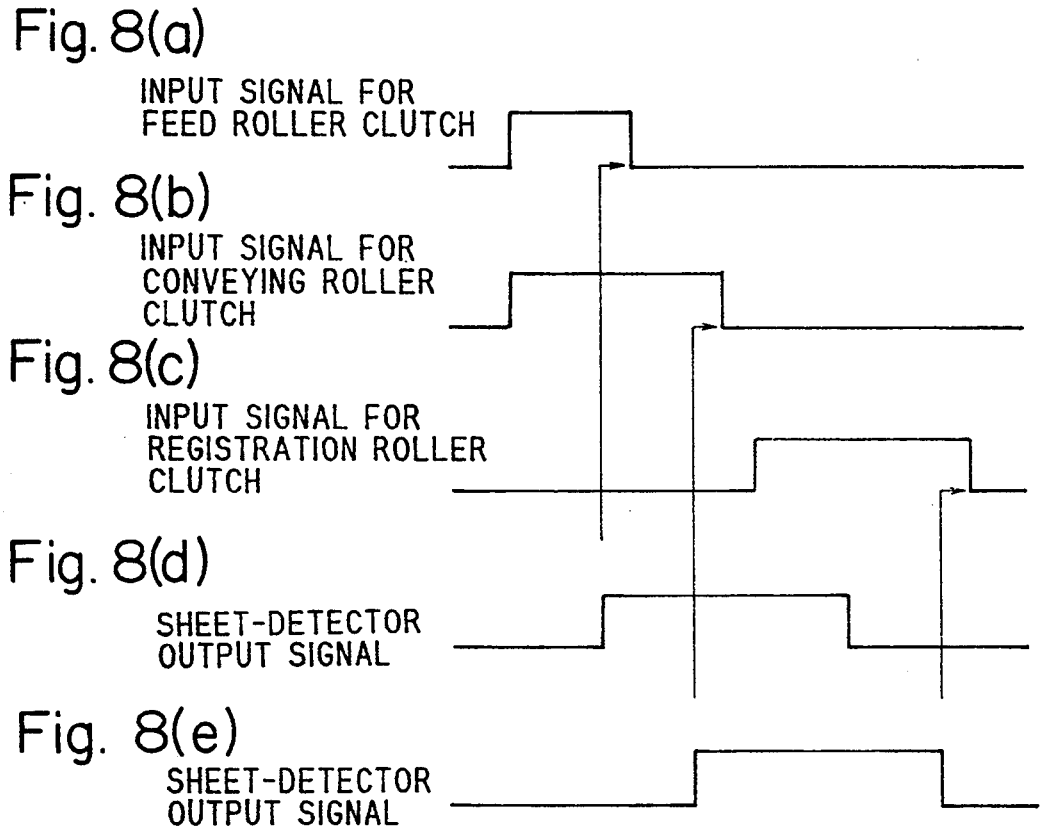
FIG. 8 is a timing chart showing operative states of rollers and sensors in the apparatus shown in FIG. 5.

In the apparatus thus constructed, when the copy switch of the copier power-supplied is activated, the rotational force of the driving gear 51 coupled with the motor will be transmitted successively to the registration roller gear 52, idler gear 54, conveying roller gear 55, idler gear 57 and feed roller gear 58. At this time, a signal (a) shown in FIG. 8 is supplied to a feed roller clutch 59 so as to instruct the clutch 59 to be coupled with the feed roller gear 58 while a signal (b) is supplied to a conveying roller clutch 70 so as to instruct the clutch 70 to be coupled with the conveying roller gear 55. Accordingly, the feed roller 38 is rotated so as to lead a topmost sheet from the storage cassette 36 to the curving guide 37*a* in a substantially U-shaped passage in a direction shown by arrow A. When the leading edge of the sheet reaches the conveying roller 39 to be nipped thereby, the sheet detector 73 detects the sheet at timing represented by a signal (d). As the signal (d) is inputted the signal (a) supplied to the feed roller clutch 59 is disabled so as to free the feed roller clutch 59 to thereby stop the rotation of the feed roller 38.

Subsequently, the sheet is led downstream in a direction shown by arrow B over the sheet-conveying guide plate 37*b* by the rotation of the conveying roller 39 driven by the feeding-conveying drive section. When the leading edge of the sheet reaches the registration roller 40 to create bending, the sheet detector 74 detects the sheet at timing represented by a signal (e). As the signal (e) is inputted the signal (b) supplied to the conveying roller clutch 70 is disabled so as to free the conveying roller clutch 70 to thereby stop the rotation of the conveying roller 39. At this time, although the conveying roller 39 continues to rotate, the registration roller 40 remains still because the driving force can not be transmitted to the registration roller 40 through the timing belt 66 and pulley 64 due to the existence of the one-way clutch 75 incorporated in the pulley 65 fit on the rotary shaft 39*a* of the feed roller 39.

Next, the registration roller clutch 60 is supplied with a signal (c) shown in FIG. 8, and consequently the registration roller clutch 60 is coupled with the registration roller gear 52 so as to rotate the registration roller 40. Simultaneously, the driving force of the driving gear 51 is transmitted to the conveying roller through the conveying-registration drive section including rotary shaft 40*a*, pulley 64, timing belt 66 and pulley 65. Accordingly, the conveying roller 39 and the registration roller 40 rotate in synchronization with one another. As a result, the sheet is conveyed in a direction shown by arrow C toward the photoreceptor 26. When the sheet detector 74 detects the trailing edge of the sheet, the registration roller clutch 60 is freed from the registration roller gear 52, whereby the conveying roller 39 and the registration roller 40 stop rotating.

Since the paper feeder of the above embodiment according to the present invention is thus constructed, it is possible to completely synchronize the movement of the conveying roller with that of the registration roller by the simple two-speed change structure of the feeding-conveying and conveying-registration drive sections. Accordingly, it is possible to eliminate irregularity of movement of sheets due to dispersion of clutch-coupling timing. In addition, in this apparatus, when the sheet delivered by the feed roller reaches the conveying roller, the rotation of the feed roller will halt so that the sheet can be moved only by the conveying roller. Therefore, there is no need to limit the distance between the feed roller and conveying roller when the apparatus is to be designed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper feeder having a feed roller, a conveying roller and a registration roller arranged so as to define a sheet-conveying path along which sheets are conveyed from a sheet-storage portion to a photoreceptor, comprising:

a feeding-conveying drive means for driving said conveying roller in synchronization with the rotation of said feed roller as said feed roller rotates; and a conveying-registration drive means for driving said conveying roller in synchronization with the rotation of said registration roller as said registration roller rotates, said feeding-conveying drive means having a one-way clutch which will transmit no driving force through said conveying-registration drive means from said registration roller to said feed roller, and said conveying-registration drive means having a one-way clutch which will transmit no driving force through said feed-conveying drive means from said feed roller to said registration roller.

2. A paper feeder having a feed roller, a conveying roller and a registration roller arranged so as to define a sheet-conveying path along which sheets are conveyed from a sheet-storage portion to a photoreceptor, comprising:

a driving gear assembly composed of a feed roller gear to be connected to said feed roller through a feed roller clutch, a conveying roller gear to be connected to said conveying roller through a conveying roller clutch and a registration roller gear to be connected to said registration roller through a registration roller clutch; and a driving pulley assembly composed of a one-way clutch-equipped pulley disposed on the rotary shaft of said conveying roller, a pulley disposed on the rotary shaft of said registration roller and a timing belt suspended between the pulleys, characterized in that two different driving modes of said conveying roller can be set up by means of feed-conveying and conveying-registration drive means, wherein driving of said conveying roller by said feed-conveying drive means is effected through said conveying roller gear and conveying roller clutch whereas driving of said conveying roller by said conveying-registration drive means is effected through said pulley disposed on the rotary shaft of said registration roller, said timing belt and said clutch-equipped pulley disposed on the rotary shaft of said conveying roller.

3. A paper feeder according to claim 2, further comprising:

a sheet-detector which detects arrival of a sheet when the leading edge of the sheet reaches said conveying roller so as to halt a signal for activating said feed roller clutch so that said feed roller clutch may be freed to thereby stop the rotation of said feed roller; and a sheet-detector which detects arrival of the sheet when the leading edge of the sheet reaches said registration roller to create bending so as to halt a signal for activating said conveying roller clutch so that said conveying roller clutch may be freed to thereby stop the rotation of said conveying roller.

* * * * *